US006336557B1

(12) United States Patent
Rüter

(10) Patent No.: US 6,336,557 B1
(45) Date of Patent: Jan. 8, 2002

(54) SIEVE CLEANER FOR A PLANSIFTER

(75) Inventor: Reinhard Rüter, Hille-Nordhemmern (DE)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 09/555,215

(22) PCT Filed: Nov. 27, 1998

(86) PCT No.: PCT/EP98/07671

§ 371 Date: May 26, 2000

§ 102(e) Date: May 26, 2000

(87) PCT Pub. No.: WO99/28053

PCT Pub. Date: Jun. 10, 1999

(30) Foreign Application Priority Data

Nov. 29, 1997 (EP) ..... 97121003
Feb. 18, 1998 (DE) ..... 298 02 807 U

(51) Int. Cl.[7] ..... B07B 1/52
(52) U.S. Cl. ..... 209/385; 209/386; 209/388
(58) Field of Search ..... 209/379, 385, 209/386, 387, 388, 389, 390, 405, 408

(56) References Cited

U.S. PATENT DOCUMENTS 5,538,139 A * 7/1996 Keller ..... 209/405 X

FOREIGN PATENT DOCUMENTS

| | | | | |
|---|---|---|---|---|
| DE | 567 747 | | 1/1933 | |
| DE | 873 345 | | 4/1953 | |
| DE | 1 507 747 | | 7/1969 | |
| DE | 3640569 | * | 6/1988 | ..... 209/385 |
| EP | 0 536 803 B1 | | 4/1993 | |
| EP | 0 536 803 A1 | | 4/1993 | |
| EP | 0 694 341 | | 1/1996 | |
| FR | 396 457 | | 4/1909 | |
| GB | 3845 | | 3/1913 | |
| GB | 700571 | * | 12/1953 | ..... 209/386 |

* cited by examiner

*Primary Examiner*—Tuan N. Nguyen
(74) *Attorney, Agent, or Firm*—Finnegan, Henderson, Farabow, Garrett & Dunner, L.L.P.

(57) ABSTRACT

A sieve frame for a plansifter has a sieve covering, a bottom, and at least one sieve cleaner including a foot and a plurality of cleaning heads. The cleaning heads may have a brush-like or nubby configuration. The cleaning heads are configured to move erratically on the bottom in response to a vibrating movement of the sieve frame. At least a part of the foot closest to the cleaning heads resiliently supports the sieve cleaner such that the cleaning heads are under an elastic intial tension against the sieve covering.

10 Claims, 3 Drawing Sheets

SIEVE CLEANER FOR A PLANSIFTER

FIELD OF THE INVENTION

The invention relates to a sieve frame for plansifters, the sieve frame having a sieve covering, a bottom, and a sieve cleaner for the sieve frame. Such sieve cleaners are inserted in the sieve frame of the plansifter so that they will move below the sieve covering in response the shaking movement of the sieve and, in doing so, bring their cleaning devices into contact with the sieve covering in order to clean the latter.

BACKGROUND OF THE INVENTION

With conventional sieve cleaners, the cleaning devices are not constantly in contact with the sieve covering, but the cleaning effect is created essentially by the cleaning devices hitting against the sieve covering. This is facilitated, for example, by the fact that the sieve cleaner rests with one foot on an ondular grid arranged in parallel to the sieve cleaner, which is set vibrating as it moves across the ondular grid.

A conventional sieve frame has a sieve cleaner tiltingly supported with its foot on the bottom of the frame such that, at any given time, only a part of the cleaning brushes engage the sieve covering. Another sieve cleaner is known which has the form of a three-armed star whose cleaning devices are arranged in the area of the free ends of the three cantilever arms arranged in an angular distance of some 120 degrees. This sieve cleaner rests on the level sieve bottom with one foot so that, with the shaking motion of the sieve, the sieve cleaner executes a wobbling movement and hits the sieve covering. The foot can engage in a bottom-clearing device that supports the clearing of the sieve-throughs toward a slot opening provided at the edge of the sieve frame.

The advantage of this known sieve cleaner is that it allows a small overall height of the sieve frame, and that it can easily reach into the corners of the sieve frame with its cantilever arms so that the sieve covering is thoroughly cleaned, including in the corner zones.

When the sieve cleaner bumps against the edge of the sieve frame, the free ends of two arms are in contact with the edge of the sieve frame while the third arm points to the center of the sieve. This results in the fact that cleaning devices treat the central area of the sieve statistically more often than the peripheral areas. This can cause an uneven cleaning effect and lead to an increased wear of the sieve covering in the center of the sieve.

The problem to be solved by the invention is to provide a sieve frame and a sieve cleaner that allow an intensive as well as gentle cleaning of the sieve covering.

SUMMARY OF THE INVENTION

This problem is solved by a sieve frame comprising a sieve covering, a bottom, and at least one sieve cleaner having a foot and a plurality of cleaning heads having, for example, a brush-like or nubby configuration. The heads are configured to move erratically on the bottom in response to a shaking or vibrating movement of the sieve frame. One of the foot and at least part of the foot closest to the cleaning heads resiliently supports the sieve cleaner, for example by a spring, such that the cleaning heads are under a elastic initial tension against the sieve covering. The problem further is solved by a sieve cleaner for use with the sieve frame, the foot of the sieve cleaner being arranged so as to be offset with respect to the cleaning heads. The part of the foot closest to the cleaning heads is located between the cleaning heads and the center of gravity of the sieve cleaner.

Various advantageous embodiments of the invention can be taken from the appended claims.

With the sieve frame in accordance with the invention the cleaning devices are resiliently prestressed against the sieve covering by a foot supported by a spring so that potential dimensional tolerances in the distance between the sieve bottom and the sieve covering, e.g. owing to a slight arching of the sieve bottom, do not cause the sieve cleaner to get jammed.

The cleaning effect is not provided by hitting against the sieve covering, but instead by the fact that the cleaning devices are running over the sieve covering. The fact that all cleaning devices are continually and efficiently cleaning the sieve more than compensates for forgoing the hits against the sieve covering. Another advantage results from more evenly distributed contact of the cleaning devices with the bottom, thus resulting in less wear and tear in one particular area.

According to another aspect of the invention, in an embodiment of the sieve cleaner, the bulk of the cleaning devices is essentially arranged in a line, and a spacer that is not, or at least less densely, fitted with cleaning devices protrudes from the line of cleaning devices toward one side.

When the sieve cleaner bumps against the edge of the sieve frame, it can be aligned in such a manner that the line of cleaning devices is almost in parallel with the edge of the sieve frame. This assists in a relatively large surface of the sieve covering being treated by the cleaning devices in the area close to the edges, while the spacer—protruding to the inside at this moment—is less or not at all involved in the cleaning. In this way, on the statistical average, a more even cleaning of the sieve covering is achieved and an excessive wear of the sieve covering in the central area of the sieve is avoided.

Preferably, the spacer is not fitted with cleaning devices and is arranged in a T-shape in reference to the line of cleaning devices. Also preferably, the foot on which the sieve cleaner rests on the level sieve bottom, which can simultaneously serve as a bottom-clearing-device, is provided under the spacer so that it is in contact with the sieve bottom in at least two places. This serves the purpose of limiting the possible movement of the sieve cleaner so that the entire line of the cleaning devices is permanently kept in contact with the sieve covering.

The sieve frames of a plansifter usually are of a square layout. It is possible to obtain a specifically even cleaning effect when the length of the sieve cleaner measured from the line of the cleaning devices to the free end of the spacer has almost half the edge length of the sieve frame.

The preferred embodiments will be explained in detail by means of the following drawings.

BRIEF DESCRIPTION OF THE DRAWINGS

Depicted in

DESCRIPTION OF THE PREFERRED EMBODIMENTS

Figure 1:
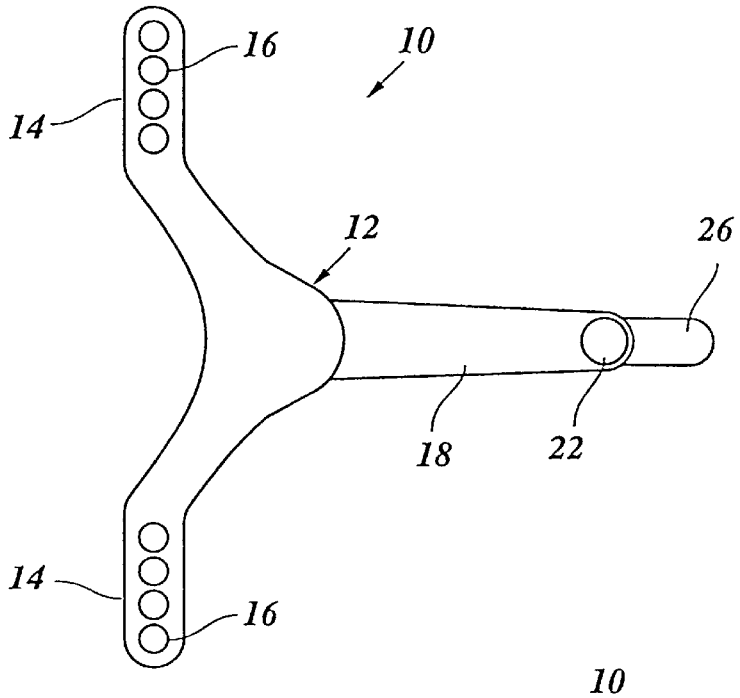
FIG. 1 is a of a sieve cleaner, with some features of the invention shown.
Figure 2:
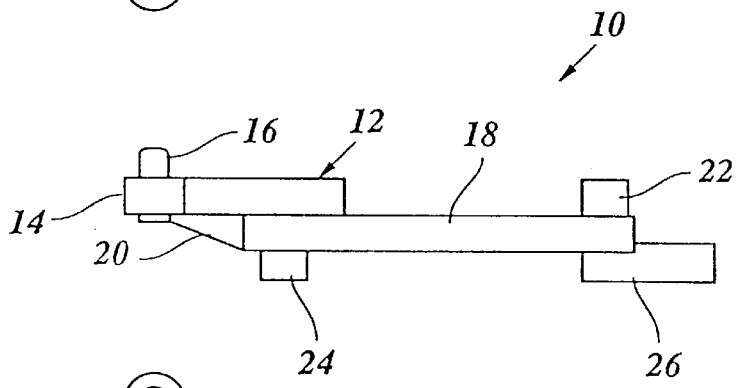
FIG. 2 is a lateral view of the sieve cleaner in accordance with FIG. 1.
Figure 3:
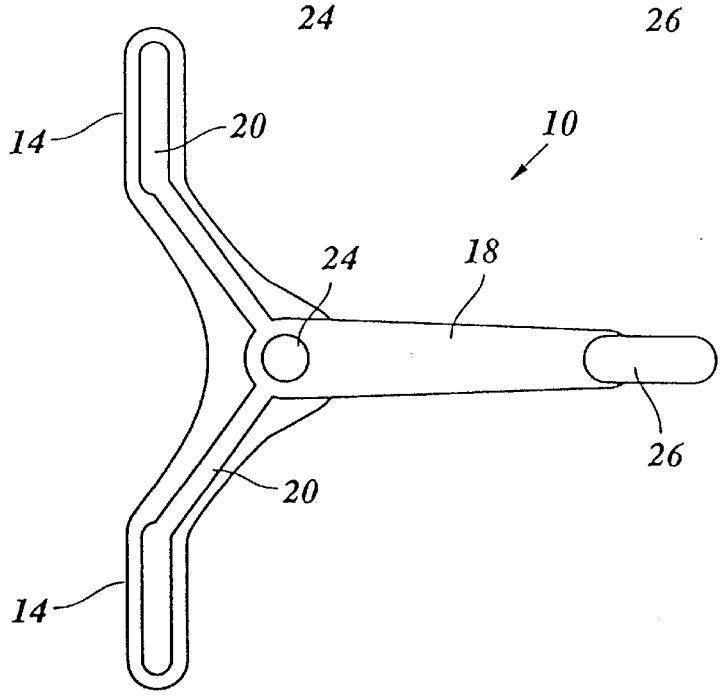
FIG. 3 is a view from under the sieve cleaner in accordance with FIGS. 1 and 2.

The sieve cleaner 10 depicted in FIGS. 1 through 3 comprises a rubber-elastic body that has an almost T-shaped layout. This body 12 forms two cantilever arms 14 which are essentially aligned on one line and carry on their upper side several cleaning devices 16 arranged in one line. The cleaning devices 16 can be provided by naps that form one single piece with the body and have a nubby configuration, or, alternately, by bunches of bristles inserted in the body 12.

The body 12 also forms a spacer 18, arranged in T-shape with reference to the line of cleaning devices 16 and placed out-of-line somewhat below the cantilever arms 14.

At the underside of the cantilever arms 14 stiffening fins 20 are provided, which link up with one end of the spacer 18. At the opposite end, the spacer 18 has a rising projection 22, the upper end of which is positioned lower than the upper ends of the cleaning devices 16.

One foot of the sieve cleaner is formed by two cams 24, 26 provided at the underside of the spacer 18. The cam 24 has a circular layout and is located in the vicinity of the end of the spacer 18 facing the arms 14, while the cam 26 has an oblong layout and protrudes in axial direction beyond the opposite end of the spacer 18.

Figure 4:
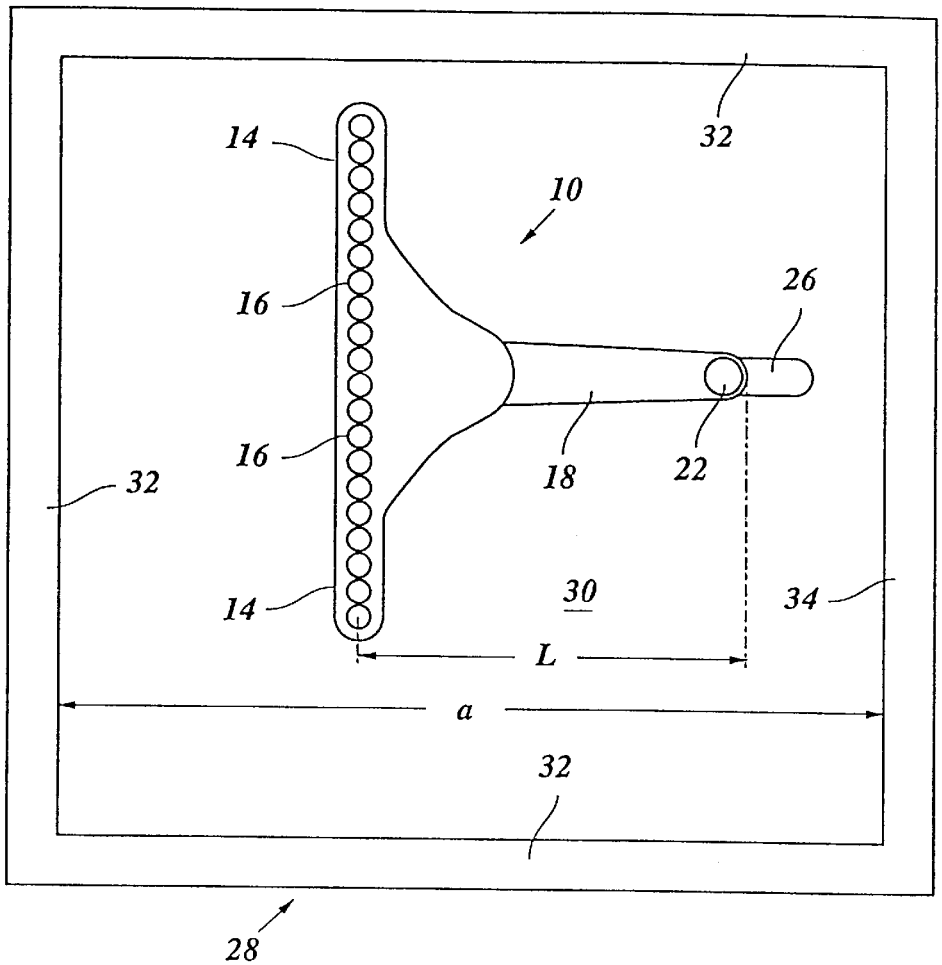
FIG. 4 is the layout of a sieve frame of a plansifter with a sieve cleaner, illustrating further features of the invention.
Figure 5:
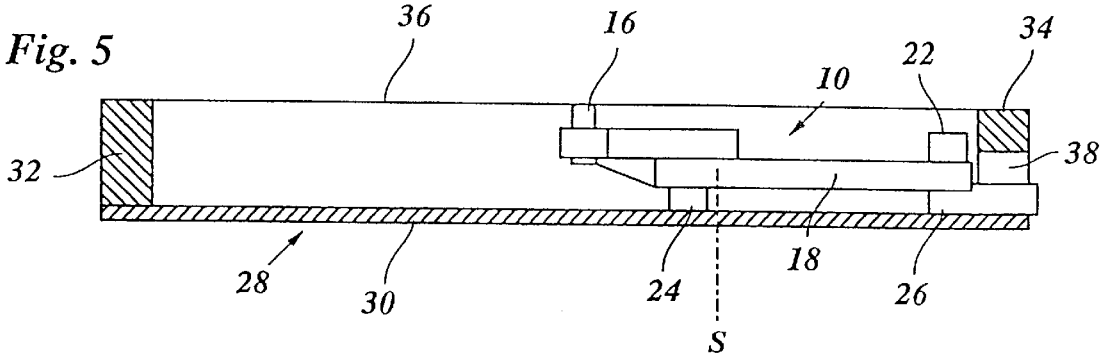
FIG. 5 is a vertical section through the sieve frame in accordance with FIG. 4.

While the cantilever arms for the sieve cleaner 10 in accordance with FIGS. 1 through 3 are slightly bent, FIGS. 4 and 5 depict a modified embodiment with the arms 14 linked to one another in a straight-lined way and carrying a continuous straight line of cleaning devices 16. As for the rest, the sieve cleaner in accordance with FIGS. 4 and 5 has the same structure as the one in accordance with FIGS. 1 through 3.

Moreover, FIGS. 4 and 5 depict a sieve frame 28 of a plansifter. Said sieve frame has a level bottom 30 and is delimited by four walls 32, 34. Additionally, the sieve frame 28 has a sieve covering 36 that is arranged at a distance in parallel to the bottom 30. Together with the bottom 30, the wall 34 of the sieve frame forms a slot opening 38 for the sieve-throughs.

With its cams 24, 26 aligned on a straight line, the sieve cleaner 10 rests on the level bottom 30 of the sieve frame, and its height is adapted to the sieve frame so that all cleaning devices 16 come against the underside of the sieve covering 36, as is shown in FIG. 5. Because the cams 24, 26 and the bottom 30 define one contact line that runs in rectangular direction as compared to the line of cleaning devices 16, the sieve cleaner 10 per se could tilt around this contact line. This is, however, prevented by the cleaning devices 16 coming into contact with the sieve covering. Therefore, the cams 24 with their flat underside glide over the surface of the bottom 30 and can hence serve as bottom clearing device.

Moreover, the height of the cam 26 is dimensioned in such a way that it can also enter the slot opening 38, as depicted in FIG. 5.

Because the spacer 18 and, consequently, the cams 24, 26 are arranged out-of-line vis-à-vis the line of the cleaning devices 16, the sieve cleaner can tilt around the cam 24. Normally, however, this is prevented because the center of gravity S of the sieve cleaner is placed out-of-line vis-à-vis the cam 24 slightly toward the cam 26. If, in exceptional cases, for example, when strong vibrations occur, the sieve cleaner actually tilts, the rotational area will be limited by the fact that the projection 22 leans onto the sieve covering. A tilting of the sieve cleaner 10 can also take place if the distance between the bottom 30 and the sieve covering 36 is changed owing to distortion or arching of the bottom 30. In this case, the tiltable support of the sieve cleaner prevents any jamming between the bottom and the sieve covering. A certain elastic resilience of the arms 14 can further contribute to this effect.

Figure 6:
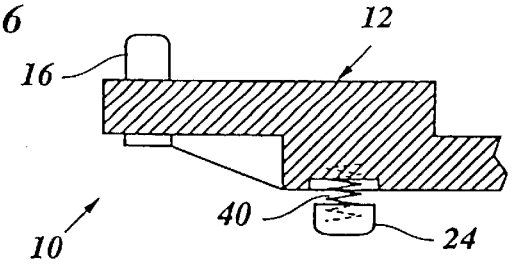
FIG. 6 is a partial section through a sieve cleaner in accordance with an embodiment of the invention.

FIG. 6 depicts a variant in which the cam 24 rests on the body 12 of the sieve cleaner via a spring 40. This method allows a precise adjustment of the elastic prestress that presses the cleaning devices 16 against the sieve covering 36.

The sieve frame 28 has a roughly square layout with an edge length a. The length L of the sieve cleaner 10, measured from the line of the cleaning devices 16 to the free end of the spacers 18, is roughly a/2.

During operation of the plansifter, the sieve frame 28 is put in a shaking motion, so that the sieve cleaner 10 executes erratic movements on the bottom 30. When the sieve cleaner has almost reached the orientation as depicted in FIG. 4, the cleaning devices 16 can clean the left half of the sieve covering up to the sieve edge, however, they cannot reach the right half of the sieve covering because the spacer 18 will then bump against the wall 34 of the sieve cleaner. When the sieve cleaner has reached the opposite orientation, likewise, only the right half of the sieve covering can be cleaned. As the length L of the sieve cleaner is almost half the edge length of the sieve frame, there will neither be a large gap nor a major overlap between the two areas of the sieve covering that can be cleaned during the different orientations. The same applies analogously for orientations of the sieve cleaner which are rotated by 90 degree as compared to the orientation depicted in FIG. 4. Because orientations of the sieve cleaner vary statistically, an almost even cleaning and, consequently an almost even wear of the sieve covering, is achieved on average for the entire surface of the sieve covering. Owing to the statistic nature of this consideration, it is not important to be very exact in dimensioning the length L.

Figure 7:
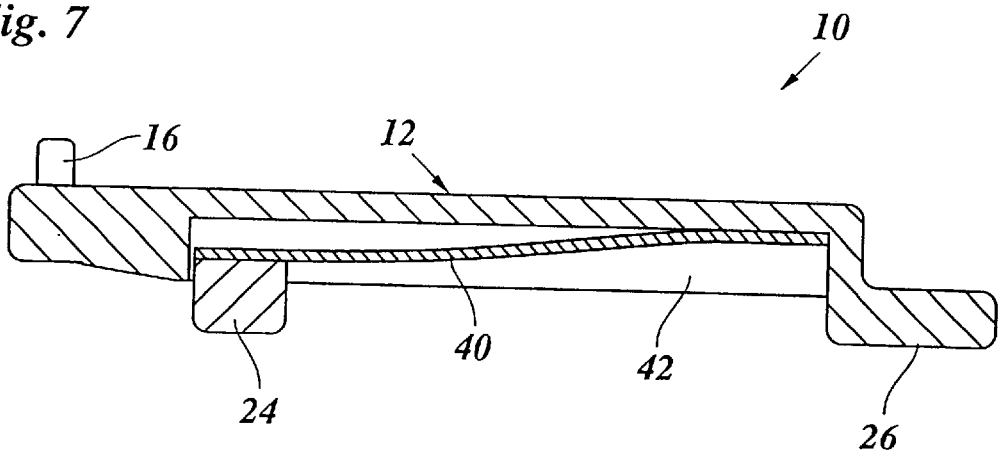
FIG. 7 is a longitudinal section of a sieve cleaner in accordance with another embodiment.

FIG. 7 depicts another embodiment of a sieve cleaner 10, which is structured similarly to the sieve cleaner in accordance with FIG. 6. However, the spring 40 that supports the cam 24 is not provided as a helical spring, but as a long stretched-out leaf spring positioned in a similarly oblong recess 42 on the underside of the body 12.

Figure 8:
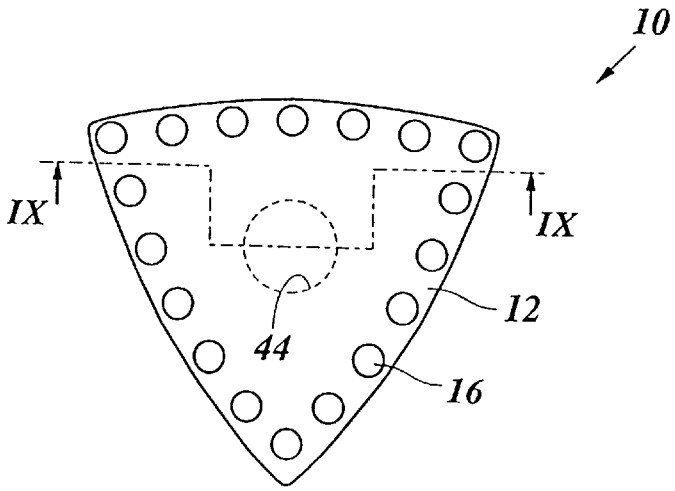
FIG. 8 is the top view of a sieve cleaner in accordance with another embodiment.
Figure 9:
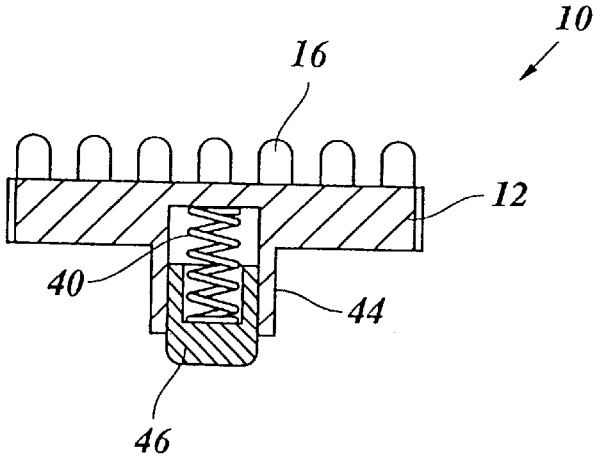
FIG. 9 is a section along the line IX—IX in FIG. 8.

FIGS. 8 and 9 depict a sieve cleaner 10 whose body 12 is designed like those of conventional sieve cleaners as a flat plate that has a layout in the form of an equilateral triangle with rounded convex sides and is fitted with cleaning devices 16 on the entire circumferential edge. On the underside of the body 12, a cylindrical bushing 44 is formed in the center and holds and allows vertical movement of a piston that forms the foot 46 of the sieve cleaner. The spring 40 sitting between the foot 46 and the body 12 is again provided as a helical spring and held in the bushing 44.

The sieve cleaner in accordance with FIGS. 8 and 9 also rests with its foot 46 on the level sieve bottom so that the cleaning devices 16 are softly pressed against the sieve covering by the spring 40. Consequently, all the cleaning devices 15 are constantly in effect. When the sieve bottom is slightly distorted, the spring 40 can give way elastically so that the sieve cleaner will not get jammed in the clearance between the sieve bottom and the sieve covering.

Just as the body 12, the foot 46 can be made of a rubber-elastic material. When the sieve cleaner moves inside the sieve frame, it is possible that the foot 46 "grinds" on the level sieve bottom so that a minor vibration is created, which will support the cleaning effect.

What is claimed is:

1. A sieve cleaner for a sieve frame for flat sifters comprising a sieve covering and a bottom, the sieve cleaner comprising:

a foot and a plurality of cleaning heads, said heads being configured to move erratically on the bottom of the sieve frame in response to a vibrating movement of the sieve frame, wherein at least one of the foot and at least a part of the foot closest to the cleaning heads, resiliently supports the sieve cleaner such that the cleaning heads are under an elastic initial tension against the sieve covering, wherein the foot of the sieve cleaner is arranged so as to be offset with respect to the cleaning heads, and the part of the foot closest to the cleaning heads is located between these cleaning heads and the center of gravity of the sieve cleaner, wherein a majority of the cleaning heads are arranged essentially in one row, and a spacer having one of no cleaning heads and fewer cleaning heads than are in said one row, projects to one side away from the row of cleaning heads, and wherein the spacer forms a foot which is offset on the whole with respect to the row of cleaning heads and defines at least two support points which are arranged at a distance from one another on a straight line perpendicular to the row of cleaning heads.

2. The sieve cleaner of claim 1, further comprising arms for carrying cleaning heads, wherein the sieve cleaner is made of elastically flexible material at least in the area of the arms carrying the cleaning heads.

3. The sieve cleaner of claim 1, further comprising arms for carrying the row of the cleaning heads, wherein the spacer is arranged in a T shape with respect to the arms of the sieve cleaner carrying the row of the cleaning heads.

4. The sieve cleaner of claim 1, wherein the spacer has a projection on the free end, the projection having a height that is lower than the height of the cleaning heads.

5. The sieve cleaner of claim 1, wherein the cleaning heads have one of a brush-like and nubby configuration.

6. The sieve cleaner of claim 1, wherein one of the foot and at least a part of the foot closest to the cleaning heads resiliently supports the sieve cleaner via a spring.

7. A sieve system comprising:

a sieve frame for flat sifters having a sieve covering and a bottom; and a sieve cleaner for the sieve frame, said sieve cleaner having a foot and brush-like or nubby cleaning heads arranged in essentially one row and configured to move erratically on the bottom in response to a vibrating movement of the sieve frame, wherein at least one of the foot and a part of the foot closest to the cleaning heads supports the sieve cleaner over a spring so that the cleaning heads are under a flexible initial tension against the sieve covering, and a spacer with one of no cleaning heads and fewer cleaning heads than are arranged in said one row projecting to one side away from the row of cleaning heads, wherein the length of the sieve cleaner measured from the row of cleaning heads to the free end of the spacer is approximately half the edge length of the sieve frame, the sieve frame being approximately square, and wherein the spacer forms a foot which is offset on the whole with respect to the row of cleaning heads and defines at least two support points which are arranged at a distance from each other on a straight line perpendicular to the row of cleaning heads.

8. The sieve system of claim 7, wherein the sieve cleaner is supported on a smooth bottom of the sieve frame.

9. The sieve system of claim 7, further comprising arms for carrying the row of cleaning heads, wherein the spacer of the sieve cleaner is arranged in a T shape with respect to the arms of the sieve cleaner carrying the row of the cleaning heads.

10. The sieve system of claim 7, wherein the spacer has a projection on the free end, the projection having a height that is lower than the height of the cleaning heads.

* * * * *